US011540372B2

(12) United States Patent
Huang et al.

(10) Patent No.: US 11,540,372 B2
(45) **Date of Patent: *Dec. 27, 2022**

(54) POWER CONVERTER, LED DRIVER AND CONTROL METHOD

(71) Applicant: Silergy Semiconductor Technology (Hangzhou) LTD, Hangzhou (CN)

(72) Inventors: Qiukai Huang, Hangzhou (CN); Jianxin Wang, Hangzhou (CN); Qingliang Zheng, Hangzhou (CN)

(73) Assignee: Silergy Semiconductor Technology (Hangzhou) LTD, Hangzhou (CN)

( * ) Notice: Subject to any disclaimer, the term of this patent is extended or adjusted under 35 U.S.C. 154(b) by 3 days.

This patent is subject to a terminal disclaimer.

(21) Appl. No.: 16/816,446

(22) Filed: Mar. 12, 2020

(65) Prior Publication Data

US 2020/0214106 A1 Jul. 2, 2020

Related U.S. Application Data

(63) Continuation of application No. 16/207,293, filed on Dec. 3, 2018, now Pat. No. 10,652,960.

(30) Foreign Application Priority Data

Dec. 11, 2017 (CN) ..... 201711307921.2

(51) Int. Cl.
*H05B 45/37* (2020.01)
*H05B 45/40* (2020.01)

(52) U.S. Cl.
CPC ..... *H05B 45/37* (2020.01); *H05B 45/40* (2020.01)

(58) Field of Classification Search
CPC .... H05B 41/34; H05B 33/0803; H05B 39/09; H05B 41/28; H05B 33/0809; H05B 33/0815; H05B 33/0818; H05B 41/2828; H05B 41/3921; H05B 41/3927; H05B 37/029; H05B 37/0254; H05B 37/02
See application file for complete search history.

(56) References Cited

U.S. PATENT DOCUMENTS

| | | | | |
|---|---|---|---|---|
| 8,614,551 | B2 | 12/2013 | Chen et al. | |
| 9,125,270 | B2 | 9/2015 | Liao et al. | |
| 9,578,706 | B1 | 2/2017 | Lai et al. | |
| 9,681,511 | B1 | 6/2017 | Barbosa | |
| 2010/0308739 | A1 | 12/2010 | Shteynberg et al. | |
| 2011/0266466 | A1* | 11/2011 | Hautala ..... | H01J 37/3178 250/492.21 |

(Continued)

FOREIGN PATENT DOCUMENTS

CN 105979630 A 9/2016

*Primary Examiner* — Minh D A

(57) ABSTRACT

A power converter for an LED drive circuit, can include: a capacitor and an LED load coupled in parallel to receive an output signal of a rectifier circuit; a power switch coupled in series with the LED load, and being configured to control a current path from the rectifier circuit to the LED load; and a control circuit configured to control the power switch to be turned off in accordance with an error between an output current flowing through the LED load and a desired current value to decrease power consumption of the power switch, where the operation of the power switch is controlled to transition between on and off states in each sinusoidal half-wave period.

14 Claims, 13 Drawing Sheets

(56) References Cited

U.S. PATENT DOCUMENTS

| | | | | |
|---|---|---|---|---|
| 2013/0119881 | A1* | 5/2013 | Fang | H05B 45/10 315/210 |
| 2013/0241427 | A1 | 9/2013 | Kesterson et al. | |
| 2014/0049171 | A1 | 2/2014 | Liang et al. | |
| 2014/0062322 | A1 | 3/2014 | Yu et al. | |
| 2016/0172983 | A1* | 6/2016 | Huang | H02M 3/33507 363/21.12 |
| 2016/0285366 | A1 | 9/2016 | Lee et al. | |
| 2016/0345395 | A1* | 11/2016 | Chen | H05B 45/20 |
| 2017/0027029 | A1* | 1/2017 | Hu | H05B 45/37 |
| 2017/0181234 | A1* | 6/2017 | Huang | H05B 45/37 |
| 2017/0188420 | A1* | 6/2017 | Kido | H05B 47/25 |
| 2017/0196055 | A1* | 7/2017 | Jao | H05B 45/10 |
| 2017/0250620 | A1* | 8/2017 | White | H02M 1/4258 |
| 2017/0279300 | A1* | 9/2017 | Catalano | H02J 7/04 |
| 2017/0318639 | A1* | 11/2017 | Wang | H05B 45/395 |
| 2019/0318639 | A1* | 10/2019 | Chartier | G08G 5/065 |

* cited by examiner

POWER CONVERTER, LED DRIVER AND CONTROL METHOD

RELATED APPLICATIONS

This application is a continuation of the following application, U.S. patent application Ser. No. 16/207,293, filed on Dec. 3, 2018, and which is hereby incorporated by reference as if it is set forth in full in this specification, and which also claims the benefit of Chinese Patent Application No. 201711307921.2, filed on Dec. 11, 2017, which is incorporated herein by reference in its entirety.

FIELD OF THE INVENTION

The present invention generally relates to the field of power electronics, and more particularly to LED drivers, along with associated power converters and control methods.

BACKGROUND

A switched-mode power supply (SMPS), or a "switching" power supply, can include a power stage circuit and a control circuit. When there is an input voltage, the control circuit can consider internal parameters and external load changes, and may regulate the on/off times of the switch system in the power stage circuit. Switching power supplies have a wide variety of applications in modern electronics. For example, switching power supplies can be used to drive light-emitting diode (LED) loads.

DETAILED DESCRIPTION

Reference may now be made in detail to particular embodiments of the invention, examples of which are illustrated in the accompanying drawings. While the invention may be described in conjunction with the preferred embodiments, it may be understood that they are not intended to limit the invention to these embodiments. On the contrary, the invention is intended to cover alternatives, modifications and equivalents that may be included within the spirit and scope of the invention as defined by the appended claims. Furthermore, in the following detailed description of the present invention, numerous specific details are set forth in order to provide a thorough understanding of the present invention. However, it may be readily apparent to one skilled in the art that the present invention may be practiced without these specific details. In other instances, well-known methods, procedures, processes, components, structures, and circuits have not been described in detail so as not to unnecessarily obscure aspects of the present invention.

Figure 1:
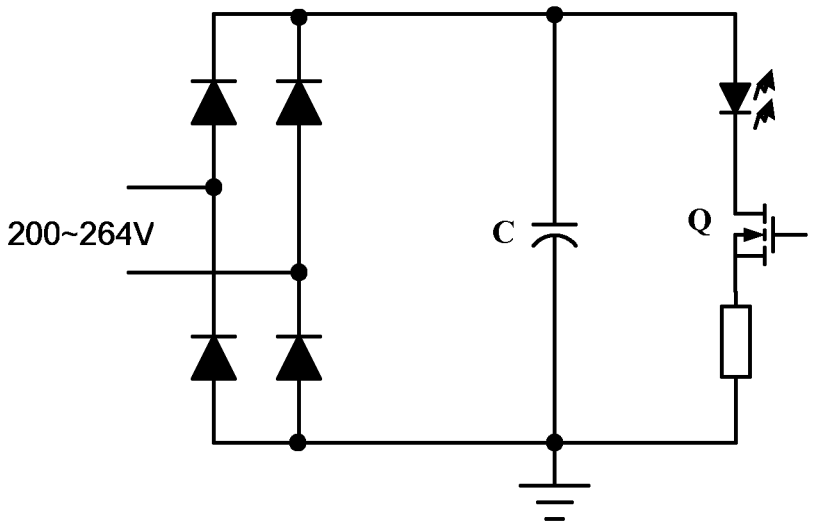
FIG. 1 is a schematic block diagram of an example LED driver utilizing a linear drive scheme.

Referring now to FIG. 1, shown is a schematic block diagram of an example LED driver utilizing a linear drive scheme. Light-emitting diode (LED) technology is widely used as a light source because of its relatively high optical efficiency, long life, and low power loss. As a constant current load, the LED load can be driven by a drive circuit capable of providing a constant current. In this example, the LED driver controls transistor Q connected in series with the LED load to operate in a linear region/state, such that the current flowing through the LED load can be kept substantially constant. The linear drive scheme has fewer components, simple control, and a higher power factor. However, a rectifier circuit may generate a sinusoidal half-wave signal that periodically fluctuates up and down. When an input voltage is low, the current flowing through transistor Q may be lowered and the linear adjustment rate may deteriorate, which can make it necessary to increase the capacitance value of capacitance C. When the input voltage is high, the power consumption of transistor Q may be increased, and the system efficiency accordingly lowered.

Figure 2:
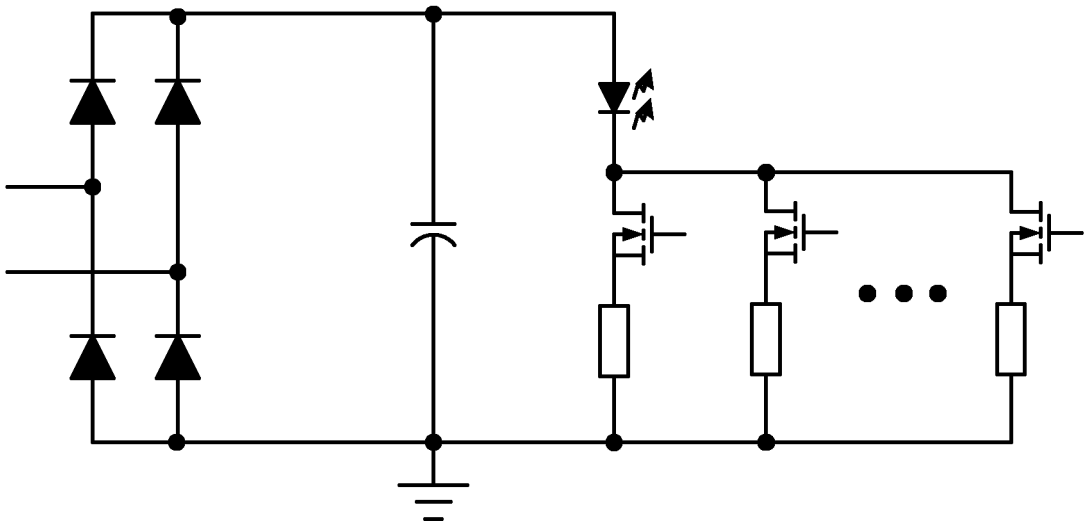
FIG. 2 is a schematic block diagram of an example LED driver.
Figure 3:
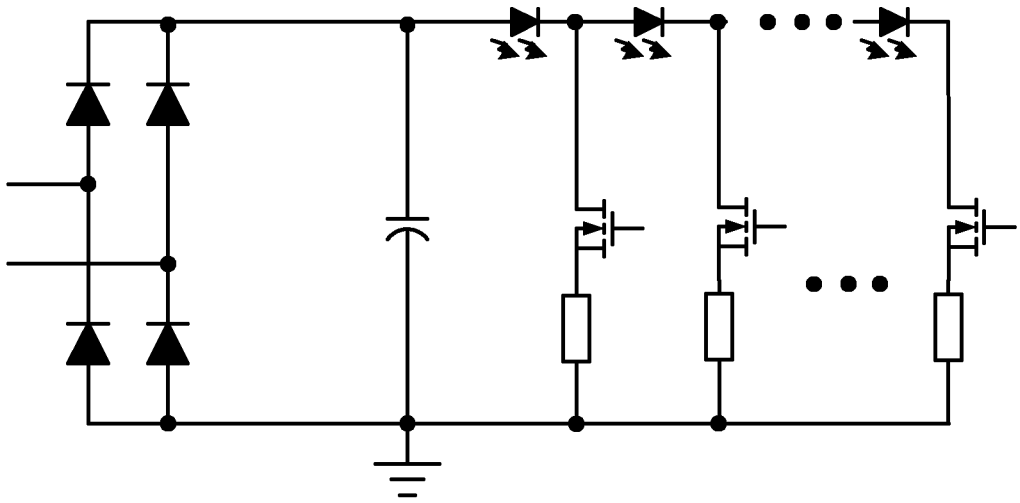
FIG. 3 is a schematic block diagram of another example LED driver.

Referring now to FIGS. 2 and 3, shown are schematic block diagrams of example LED drivers. In the example of FIG. 2, the LED driver utilizes a plurality of transistors connected in parallel to reduce the current flowing through each transistor, in an effort to reduce the heat consumption of each transistor. In the example of FIG. 3, the LED driver divides the LED loads to multiple segments, and each segment corresponds to one or more transistors, thereby reducing the voltage drop at terminals of each transistor and reducing power consumption of the transistors. However, these approaches may result in relatively complex control, with associated increased circuit scale and cost due to the arrangement of multiple transistors.

In one embodiment, a power converter for an LED drive circuit, can include: (i) a capacitor and an LED load coupled in parallel to receive an output signal of a rectifier circuit; (ii) a power switch coupled in series with the LED load, and being configured to control a current path from the rectifier circuit to the LED load; and (iii) a control circuit configured to control the power switch to be turned off in accordance with an error between an output current flowing through the LED load and a desired current value to decrease power consumption of the power switch, where the operation of the power switch is controlled to transition between on and off states in each sinusoidal half-wave period.

Figure 4:
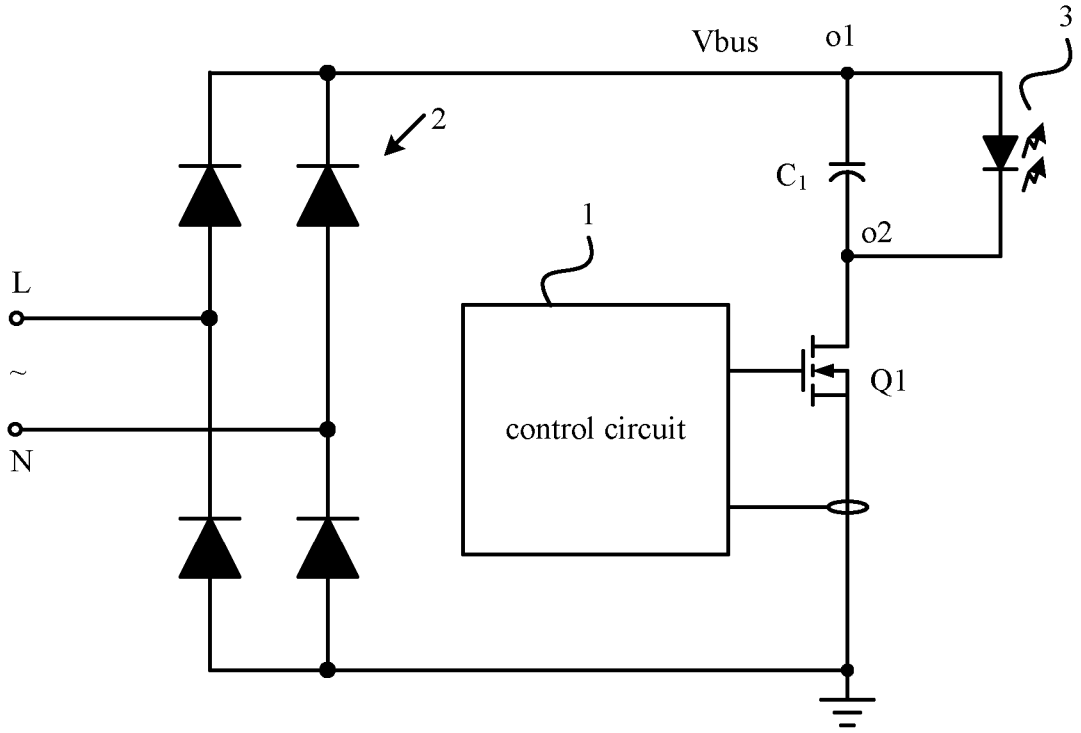
FIG. 4 is a schematic block diagram of a first example LED driver, in accordance with embodiments of the present invention.

Referring now to FIG. 4, shown is a schematic block diagram of a first example LED driver, in accordance with embodiments of the present invention. In this particular example, the LED drive circuit can include a rectifier circuit and a power converter. The power converter can include output ports o1 and o2, capacitor C1, power switch Q1, and control circuit 1. LED load 3 can connect between output ports o1 and o2. Capacitor C1 can connect in parallel with LED load 3. Power switch Q1 may be arranged on a current path from the output terminal of rectifier circuit 2 to capacitor C1 and LED load 3, and can control the on-off state of the current path. Control circuit 1 can connect to the control terminal of power switch Q1 for controlling power switch Q1 to transition between turn-on and turn-off states.

Figure 5:
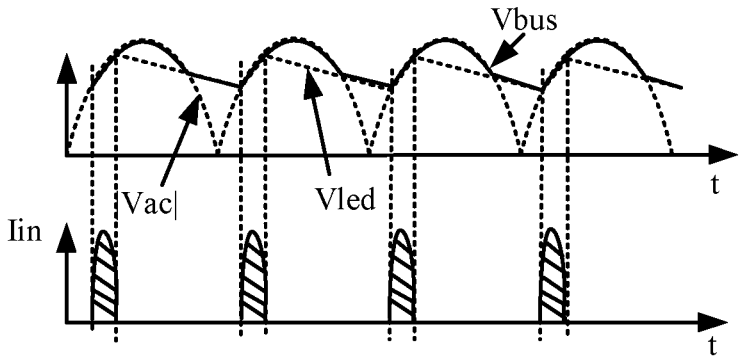
FIG. 5 is a waveform diagram of example operation of the first example LED driver, in accordance with embodiments of the present invention.

Referring now to FIG. 5, shown is a waveform diagram of example operation of the first example LED driver, in accordance with embodiments of the present invention. In this particular example, the absolute value |Vac| of an input alternative current voltage at the input terminal of rectifier circuit 2 can also represent the theoretical output voltage of rectifier circuit 2. The voltage at the output terminal of rectifier circuit 2 is input voltage Vbus of the power converter, and the voltage across LED load 3 is voltage Vled. Current Iin is the current input to capacitor C1 and LED load 3. During the turn-on state of power switch Q1, two current branches of capacitor C1 and LED load 3 can form the current path with power switch Q1, and rectifier circuit 2 can generate current Iin to capacitor C1 and LED load 3. A portion of current Iin can flow to capacitor C1 to charge capacitor C1, which may cause voltage Vled across LED load 3 to increase. The other portion can flow to LED load 3, in order to drive LED load 3 to emit.

After flowing through capacitor C1 and LED load 3, current Iin can flow to ground through power switch Q1 in the turn-on state. During the turn-off state of power switch Q1, the current path between rectifier circuit 2 and capacitor C1 and LED load 3 may be cut off and current Iin may drop to zero. Thus, capacitor C1 may discharge to supply a drive current for LED load 3, in order to continue to drive LED load 3 to emit, thereby causing voltage Vled to decrease following the voltage across capacitor C1. In addition, input voltage Vbus of the power converter may be affected by input alternating current voltage Vac of rectifier circuit 2 and on-off state of power switch Q1, such that input voltage Vbus has a waveform substantially following the periodic variation of a sinusoidal half-wave signal.

As described above, if power switch Q1 is turned on for most of the entire period of the sinusoidal half-wave signal, on the one hand, when input alternating current voltage Vac of rectifier circuit 2 is relatively large, a voltage difference between voltage Vled across LED load 3 (e.g., the output voltage) and input voltage Vbus may also be relatively large, and a conduction voltage drop of power switch Q1 may also be relatively large, such that power switch Q1 may run very hot. On the other hand, when input voltage Vbus varies to a relatively small value following the sinusoidal half-wave signal, LED load 3 may not be lighted and the linear adjustment rate may be poor.

In this example, power switch Q1 can be controlled to be turned off for a predetermined time in each power frequency half-wave period. The time of entering the turn-off state and the length of the predetermined time can be set and adjusted, such that input current Iin can concentrate in a time period during which the conduction voltage drop of power switch Q1 is relatively small. That is, the voltage difference between input voltage Vbus and output voltage Vled is relatively small, and the output current can remain substantially constant. The voltage difference between the input voltage and the output voltage (the voltage across LED load 3) can be relatively small during the period in which the input current flows through LED load 3 and power switch Q1. The voltage across power switch Q1 can be correspondingly small, and the average value of current Iin may be substantially constant, such that power losses of power switch Q1 may be decreased, in order to reduce the heat of power switch Q1 and associated system losses. As shown in the example of FIG. 5, the time period of input current Iin may concentrate in the rising phase of the power frequency half-wave period.

Figure 6:
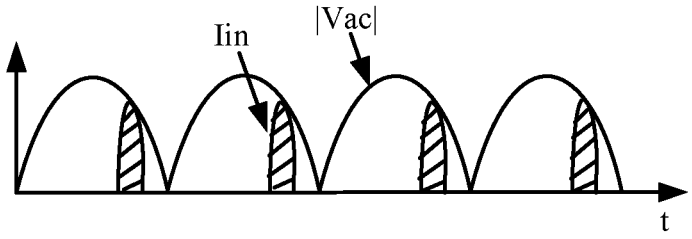
FIG. 6 is another waveform diagram of example operation of the first example LED driver, in accordance with embodiments of the present invention.

Referring now to FIG. 6, shown is another waveform diagram of example operation of the first example LED driver, in accordance with embodiments of the present invention. In this particular example, the time period of input current Iin can also be concentrated in the falling phase of the power frequency half-wave period. In particular embodiments, the power switch can be provided in a circuit at the current path from the output terminal of the rectifier circuit to the LED load and the capacitor. The power switch may be controlled to be turned off for a predetermined time in each power frequency half-wave period, thereby causing the input current to concentrate in a time period in which the conduction voltage drop of power switch Q1 is relatively small. That is, the voltage difference between the input voltage and the output voltage can be relatively small, and the output current may remain substantially constant, in order to reduce the power consumption and improve system efficiency.

Figure 7:
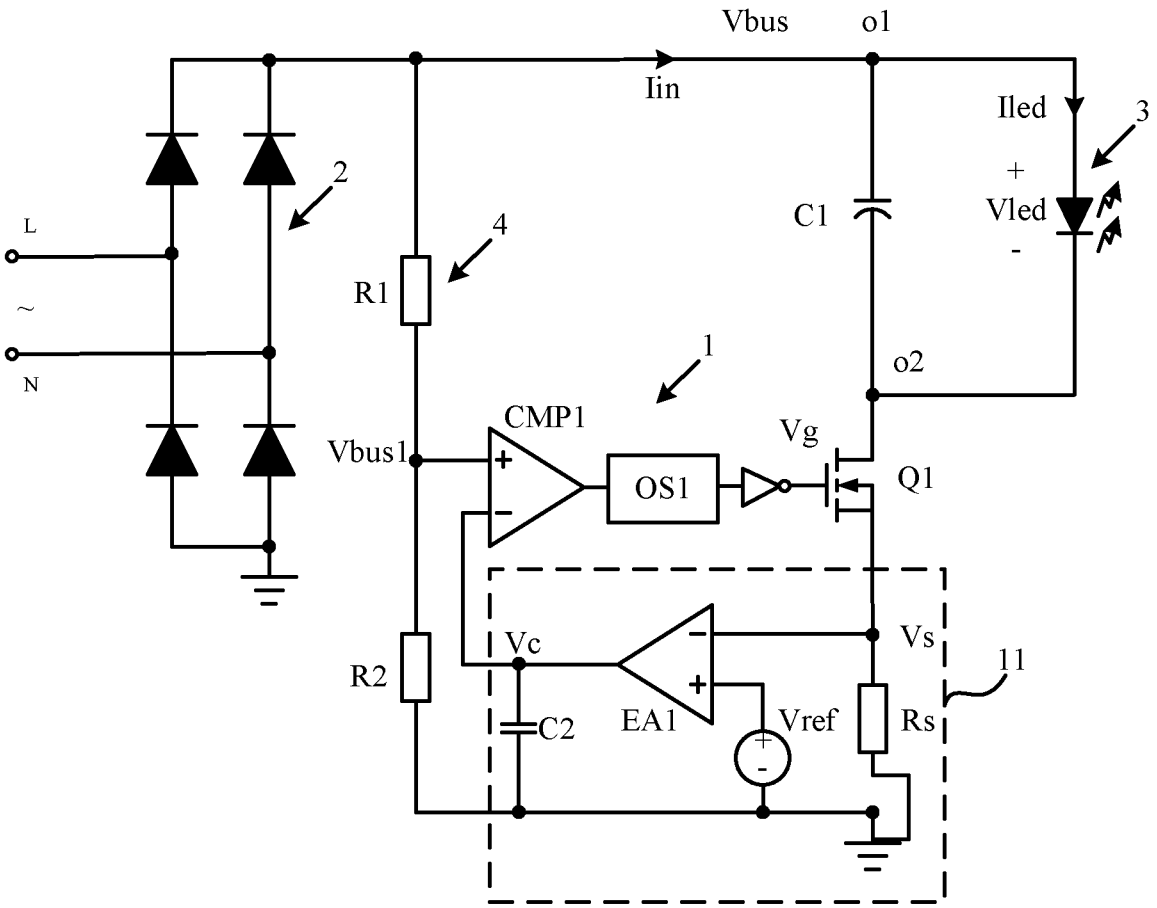
FIG. 7 is a schematic block diagram of a second example LED driver, in accordance with embodiments of the present invention.

Referring now to FIG. 7, shown is a schematic block diagram of a second example LED driver, in accordance with embodiments of the present invention. In this particular example, the power converter can connect to the output terminal of rectifier circuit 2. The power converter can include output ports of and o2, power switch Q1 and control circuit 1. LED load 3 can connect between output ports of and o2. Capacitor C1 can connect in parallel with LED load 3. Power switch Q1 can connect between the parallel circuit of LED load 3 and capacitor C1 and ground, in order to control the on-off state of the current path from the output terminal of rectifier circuit 2 to the ground. For example, power switch Q1 may be a metal-oxide-semiconductor transistor (MOSFET), and can be controlled by control circuit 1 to operate at a switch mode. It should be understood that other electronically controlled switching devices, such as bipolar transistors (BJTs) or insulated gate bipolar transistors (IGBTs), may additionally or alternatively be used as power switches in certain embodiments.

For example, control circuit 1 can control power switch Q1 to be turned off for a predetermined time in each power frequency half-wave period, such that input current Iin can concentrate in a time period in which the conduction voltage drop of power switch Q1 is relatively small. That is, the voltage difference between the input voltage and the output voltage is relatively small, and output current Iled may remain substantially constant. Control circuit 1 can adjust the on-time of the power switch according to an error between the current flowing through LED load 3 and a desired current value when the voltage difference between the two power terminals of power switch Q1 is less than a predetermined value. This can control the average value of the current flowing through LED load 3 to be consistent with the desired current value, and achieve constant current control. In another aspect, control circuit 1 can control the power switch to be turned off to control the input current to be zero when the voltage difference between the two power terminals of the power switch is greater than the predetermined value, thereby realizing control of current distribution interval and improving efficiency.

For example, the power switch can be controlled by control circuit 1 to be turned off for "first" time/duration T1 when input sampling signal Vbus1 is increased to be above compensation signal Vc. Input sampling signal Vbus1 may characterize input voltage Vbus. Compensation signal Vc can characterize the error of current Iled flowing through LED load 3 and desired current value Iref, and/or the error of the average value of input current Iin and desired current value Iref. First time duration T1 may be set such that when absolute value |Vac| of the input alternating current voltage of the rectifier circuit is less than voltage Vbus at input terminals of the power converter, power switch Q1 may again be turned on.

As shown in FIG. 7, control circuit 1 can include compensation signal generating circuit 11, comparator CMP1, and single triggered circuit OS1. Compensation signal generating circuit 11 can generate compensation signal Vc in accordance with reference voltage Vref and load current sampling signal Vs. for example, compensation signal generating circuit 11 can include sampling resistor Rs, error amplifier EA1, and capacitor C2 for a compensation circuit. Sampling resistor Rs can connect between power switch Q1 and the ground. Thus, sampling resistor Rs can sample the current flowing through power switch Q1 and convert it into voltage signal Vs. Voltage Vs as the current sampling signal can represent input current Iin.

One input terminal of error amplifier EA1 can receive current sampling signal Vs, and the other input terminal can receive reference voltage Vref that characterizes desired current value Iref. The output signal of error amplifier EA1 (which may be voltage or current) may be compensated by the compensation circuit to be an error that characterizes the average value of current Iin flowing through the LED load and desired current value Iref. For example, the compensation circuit can include capacitor C2 used for average operation for the output signal of error amplifier EA1. It should be understood that the compensation circuit may also add resistance, inductance, and/or other capacitive components, depending on the type of the output signal of the error amplifier and the difference in parameters.

One input terminal of comparator CMP1 can receive input sampling signal Vbus1, the other input terminal can receive compensation signal Vc, and the output terminal can connect to single triggered circuit OS1. Comparator CMP1 can compare input sampling signal Vbus1 against compensation signal Vc. For example, the power converter may also include input voltage sampling circuit 4 for acquiring input sampling signal Vbus1. For example, input voltage sampling circuit 4 is a resistor divider circuit that divides input voltage Vbus by resistors R1 and R2 into voltage Vbus1 that is suitable for comparator CMP1. Alternatively, input voltage sampling circuit 4 can also be any other type of circuit that samples the voltage in real time or periodically.

Single triggered circuit OS1 can respond to a rising or falling edge of the output signal of comparator CMP1 to generate control signal Vg. The operation of single triggered circuit OS1 in response to the rising edge or the falling edge of the input signal depends on the direction of the level transition of the output signal of comparator CMP1 when input sampling signal Vbus1 increases to be above compensation signal Vc. Single triggered circuit OS1 can be triggered to generate a high or low level pulse signal having first time duration/length T1, thereby controlling power switch Q1 to turn off for a predetermined time. After the end of the pulse signal generated by single triggered circuit OS1, power switch Q1 may again be turned on until the next pulse signal comes. In some cases, a logic circuit as shown in FIG. 7 can be provided between single triggered circuit OS1 and the control terminal of power switch Q1 in order to enhance the level intensity of the pulse signal, and to perform conversion of the high and low level.

Figure 8:
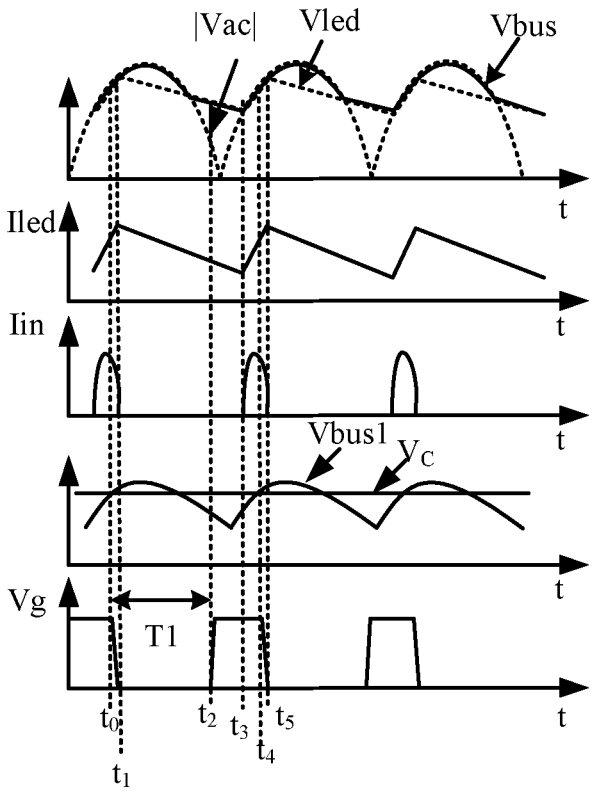
FIG. 8 is a waveform diagram of example operation of the second example LED driver, in accordance with embodiments of the present invention.

Referring now to FIG. 8, shown is a waveform diagram of example operation of the second example LED driver, in accordance with embodiments of the present invention. In this particular example, before time t0, control signal Vg is a high level and power switch Q1 may be turned on. When voltage |Vac| is greater than output voltage Vled, rectifier circuit 2 can generate current Iin to the power converter. Current Iin can increase following along with the sinusoidal half-wave waveform, and voltage Vled across LED load 3 may also be increased. Input voltage Vbus may substantially follow the sinusoidal half-wave waveform. During this period, the voltage difference between voltage Vled and input voltage Vbus can be relatively small, and thus the power consumption of power switch Q1 may be relatively small.

In addition, input sampling signal Vbus1 can be approximately increased following input voltage Vbus as the sinusoidal half-wave waveform. Compensation signal Vc may remain substantially constant. At time t0, sampling signal Vbus1 can increase above compensation signal Vc, such that pulse signal Vg generated by control circuit 1 transitions to a low level having time period T1. During the time t0-t1, power switch Q1 may gradually be turned off, input current Iin may gradually be decreased to be zero, and voltage Vled across the LED load and current Iled flowing through LED load can continue to increase. At time t1, control signal Vg may drop to a low level, power switch Q1 can be completely turned off, and input current Iin may fall to zero. In addition, capacitor C1 can be discharged to drive LED load 3 to emit, such that the voltage across LED load 3 (e.g., output voltage Vled) decreases. During time t1 and time t2, output current Iled may continuously decrease, input current Iin can remain at zero, and the output voltage across LED load 3 may continuously decrease, thereby causing input voltage Vbus to deviate from the standard of the sinusoidal half-wave signal waveform.

The time from time t2 to time t0 is time period T1. At time t2, the low level of the pulse signal ends, control signal Vg may transition to a high level, and power switch Q1 can be turned on. The length of time period T1 may be determined in accordance with the power frequency half-wave period and other parameters, such that when power switch Q1 is turned on again, absolute value |Vac| of the input alternating current voltage of rectifier circuit 2 may be less than input voltage Vbus. At time t2, since absolute value |Vac| of the input alternating current voltage is less than input voltage Vbus at the input terminal of LED load 3, rectifier circuit 2 may not generate the current to LED load 3 and capacitor C1 although power switch Q1 is turned on again, and input current Iin can remain at zero. Output voltage Vled and output current Iled may continuously decrease until time t3. At time t3, output voltage Vled may decrease to be less than absolute value |Vac| of the input alternating current voltage, thus rectifier circuit 2 can generate the current to capacitor C1 and LED load 3. Due to the influence of the alternating current input voltage at the input terminal of rectifier circuit 2, input voltage Vbus may continuously increase, which can cause output voltage Vled and output current Iled to continuously increase.

Correspondingly, input voltage sampling signal Vbus1 may increase following input voltage Vbus. At time t4, input voltage sampling signal Vbus1 can increase to be above compensation signal Vc, thereby triggering single triggered circuit OS1 to again generate the low level pulse signal having time period T1. The pulse signal can control power switch Q1 to be completely turned off at time t5. Therefore, the input current may be concentrated between time t3 to time t5. By setting the length of the pulse signal generated by the single triggered circuit, the input current can concentrate in the time period in which the voltage difference between output voltage Vled and input voltage Vbus is very small, thereby greatly reducing the power consumption and heat caused by the conduction voltage drop of power switch Q1.

Generally, the turn-off time of the power switch can be controlled by a comparison result of compensation signal Vc and input sampling signal Vbus1. Thus, in one aspect, the average value of the output current can remain substantially constant. In another aspect, when the voltage difference between output voltage Vled and input voltage Vbus is relatively large, power switch Q1 can be turned off in time to reduce the power consumption, thereby realizing balance between keeping constant current control and reducing power consumption. In addition, the linear adjustment rate of the system can be effectively improved by current closed-loop control.

Figure 9:
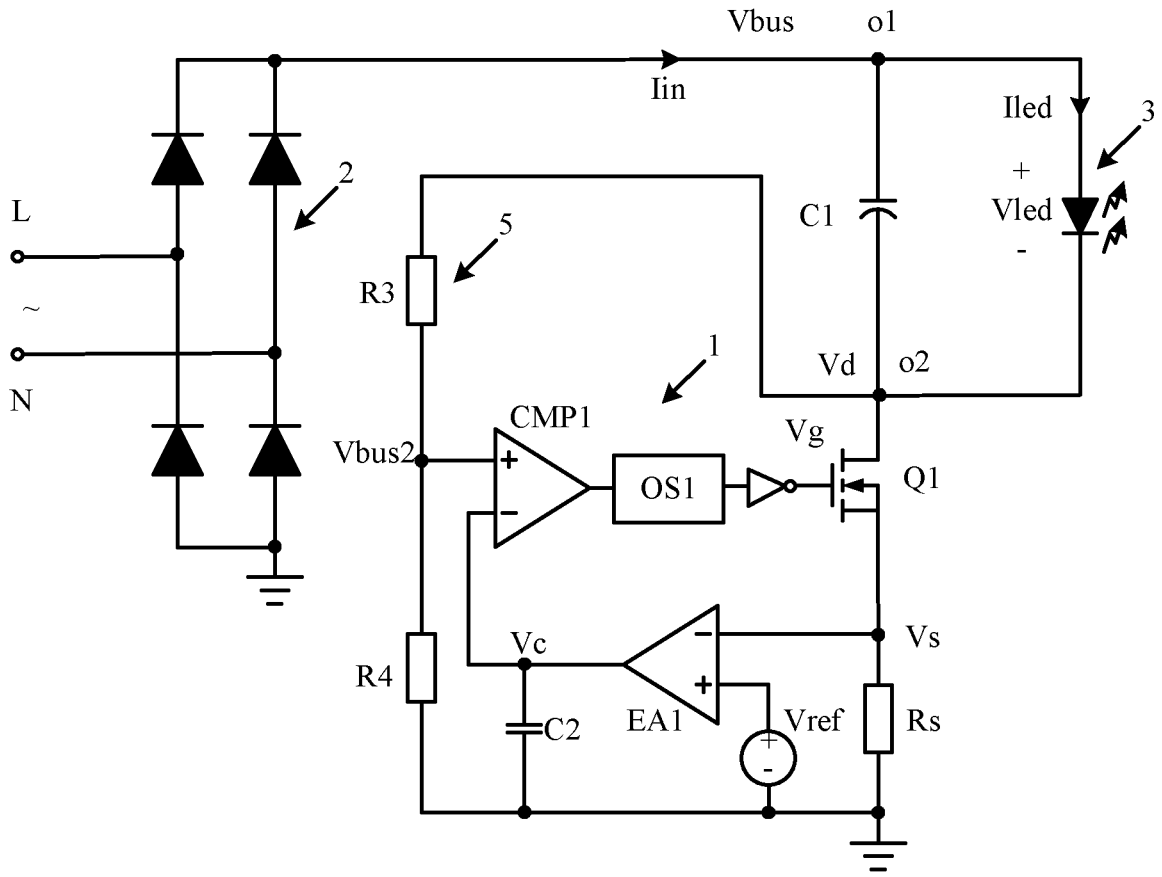
FIG. 9 is a schematic block diagram of a third example LED driver, in accordance with embodiments of the present invention.

Referring now to FIG. 9, shown is a schematic block diagram of a third example LED driver, in accordance with embodiments of the present invention. In this particular example, the power converter can sample drain voltage Vd through a voltage dividing network including resistor R3 and R4 (e.g., difference sampling circuit 5) connected to the drain terminal of power switch Q1, to obtain difference sampling signal Vbus2. The drain voltage of power switch Q1 (e.g., the voltage on the terminal of power switch Q1 near output port o2) can characterize the voltage difference between input voltage Vbus and output voltage Vled. The length of time period T1 can be controlled in accordance with an error between difference sampling signal Vbus2 and compensation signal Vc, and power switch Q1 can be turned off for time period T1 when difference sampling signal Vbus2 rises to be above compensation signal Vc. In this example, the voltage characterizing the voltage difference between the output voltage and the input voltage can be sampled at the drain terminal of power switch Q1. Sampling resistor Rs, reference voltage Vref, and the parameters of the compensation circuit, can be adjusted according to the difference sampling signal and the input sampling signal.

It should be understood that the time period of input current Iin can also be concentrated in the falling phase of the power frequency half-wave period, as shown in FIG. 6, by forming a feedback loop circuit. Alternatively, power switch Q1 can be turned on for a "second" time/duration in accordance with input sampling signal Vbus1 and compensation signal Vc, or difference sampling signal Vbus2 and compensation signal Vc. For example, when input sampling signal Vbus1 is decreased to be below compensation signal Vc, single triggered circuit OS1 can be triggered to generate an active pulse signal having time period/duration T2, such that power switch Q1 is turned on for the second time duration T2. When the active pulse signal ends, power switch Q1 may be turned off until input sampling signal Vbus1 decreases to be below compensation signal Vc again in the falling phase of the input voltage in the next power frequency half-wave period, such that power switch Q1 is turned off for a predetermined time.

For example, when difference sampling signal Vbus2 is decreased to be below compensation signal Vc, single triggered circuit OS1 can be triggered to generate an active pulse signal having time period T2, such that power switch Q1 may be turned on for a second time duration T2. When the active pulse signal ends, power switch Q1 can be turned off until input sampling signal Vbus1 is decreased to be below compensation signal Vc again in the falling phase of the input voltage in the next power frequency half-wave period. Therefore, second time duration T2 may be determined such that when the input voltage of the power switch is at a falling phase of a power frequency half-wave period, the power switch can again be turned on in next power frequency half-wave period. When power switch Q1 is turned on, rectifier circuit 2 can generate current Iin to capacitor C1 and LED load 3. Thus, on the one hand, input current Iin may be concentrated on the time period during which the voltage difference between input voltage Vbus and output voltage Vled is small, and the heating and power consumption of power switch Q1 may correspondingly be reduced. On the other hand, the average value of output current Iled can remain substantially constant.

Figure 10:
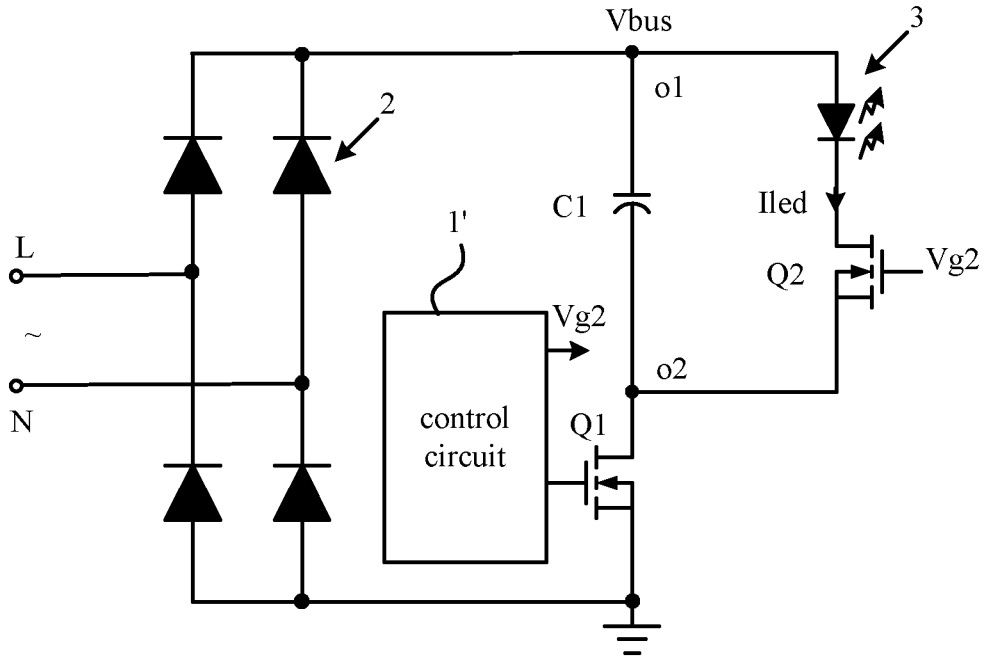
FIG. 10 is a schematic block diagram of a fourth example LED driver, in accordance with embodiments of the present invention.

Referring now to FIG. 10, shown is a schematic block diagram of a fourth example LED driver, in accordance with embodiments of the present invention. In this particular example, transistor Q2 presented as a controlled current source may be provided between output port of and output port o1. Transistor Q2 can connect in series with LED load 3, and that structure can connect in parallel with capacitor C1. Power switch Q1 may be placed on the current path from the input port to the two branches of capacitor C1 and LED load. Transistor Q2 can be controlled to operate in a linear region/state in order to control current Iled flowing through LED load 3. Control circuit 1' can control transistor Q2 in addition to controlling power switch Q1 to be periodically turned on or off. Since the output current flowing through LED load 3 can be controlled by added transistor Q2, the current ripple of the output current may be effectively reduced in this fashion.

Figure 11:
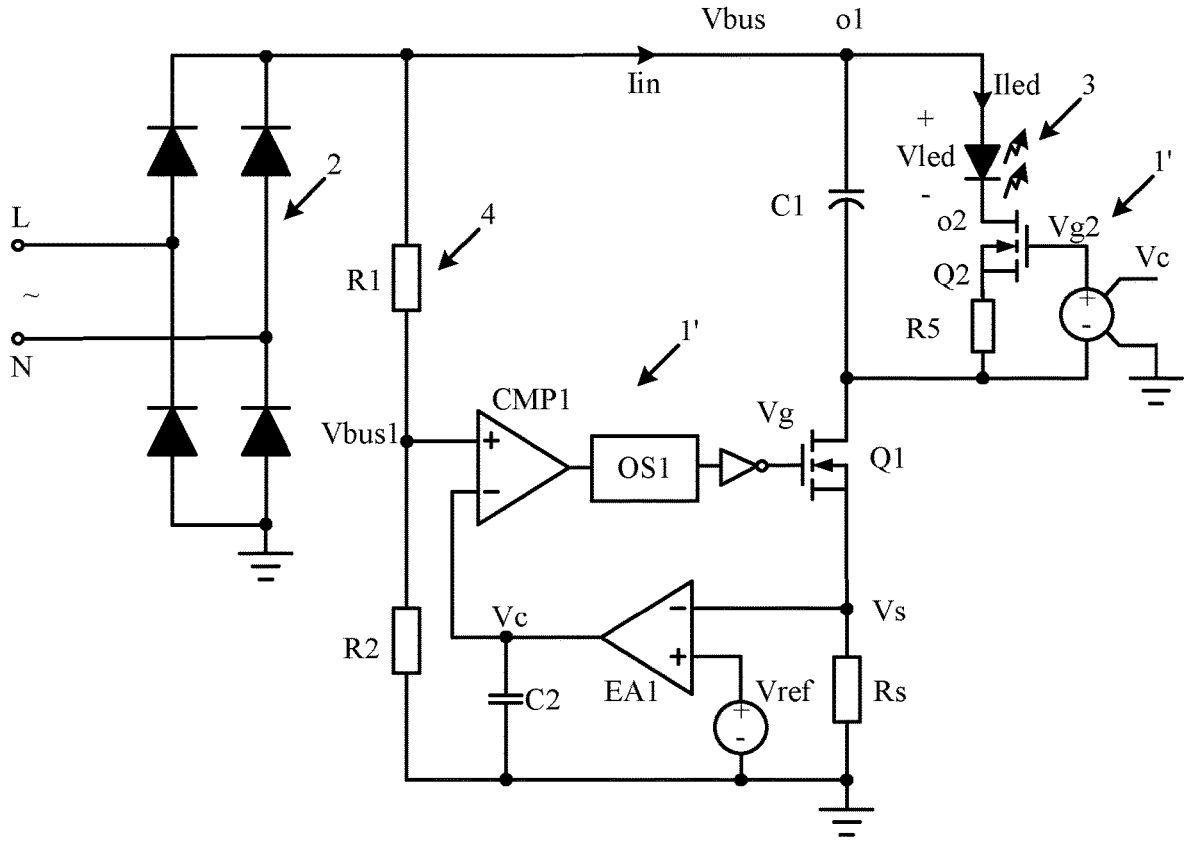
FIG. 11 is a schematic block diagram of a comparative embodiment of the fourth example LED driver, in accordance with embodiments of the present invention.

Referring now to FIG. 11, shown is a schematic block diagram of a comparative embodiment of the fourth example LED driver, in accordance with embodiments of the present invention. In this particular example, control circuit 1' can control voltage Vg2 applied to the gate terminal of transistor Q2 in accordance with compensation signal Vc, in order to control the current flowing through transistor Q2 to be substantially constant. The gate terminal of transistor Q2 can be controlled by a controlled voltage source controlled by compensation signal Vc, such that transistor Q2 can also operate in a variable resistance region according to compensation signal Vc, in order to limit the maximum current of LED load 3 and reduce the current ripple of output current Iled. Alternatively, resistor R5 connected in series with transistor Q2 can also be provided to enhance the function of limiting current and adjustment. It can be understood that other suitable ways can be implemented such that transistor Q2 is presented as a controlled current source.

Figure 12:
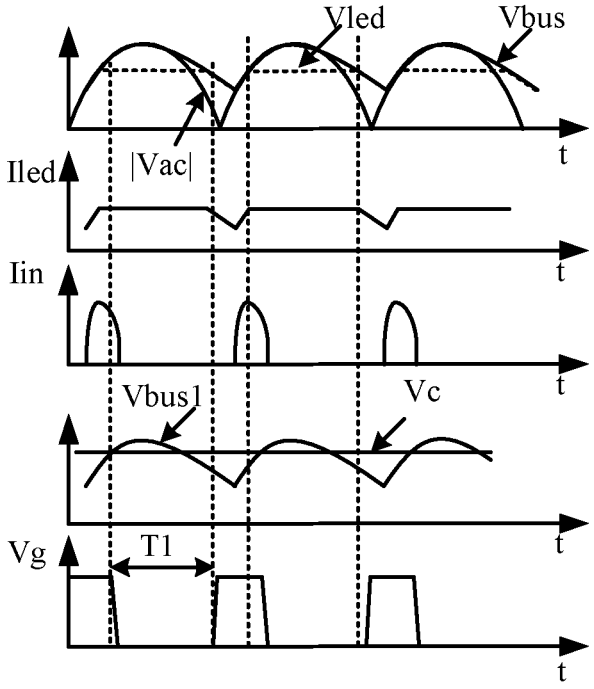
FIG. 12 is a waveform diagram of example operation of the example of FIG. 11, in accordance with embodiments of the present invention.

Referring now to FIG. 12, shown is a waveform diagram of example operation of the example of FIG. 11, in accordance with embodiments of the present invention. In this particular example, power switch Q1 may be controlled by control circuit 1' to be turned off for a predetermined time in each power frequency half-cycle, such that input current Iin is concentrated in the time period in which the voltage difference between input voltage Vbus and output voltage Vled is relatively small. That is, the time period in which the conduction voltage drop of power switch Q1 is relatively small. Transistor Q2 controlled by control circuit 1' can operate in the linear region/state in order to generate substantially constant current. Transistor Q2 can adjust output current Iled during discharge of capacitor C1, such that output current Iled is substantially constant at a predetermined value for most of the time during discharge of capacitor C1. It should be understood that, in particular embodiments, the on-off state of power switch Q1 can be controlled by sampling input voltage Vbus or the drain voltage of power switch Q1 representing the voltage difference between the source terminal and drain terminal of power switch Q1.

Figure 13:
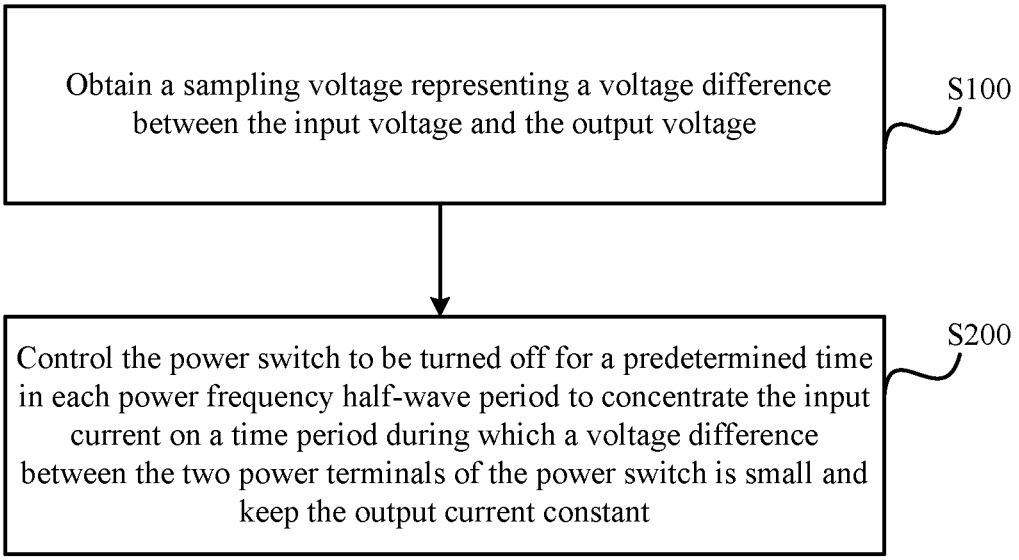
FIG. 13 is a flow diagram of an example method of controlling the LED driver, in accordance with embodiments of the present invention.

Referring now to FIG. 13, shown is a flow diagram of an example method of controlling the LED driver, in accordance with embodiments of the present invention. In this particular example, a power converter that includes a power switch for controlling a current path from the output terminal of a rectifier circuit to a capacitor and an LED load, can be controlled. At S100, a sampling voltage representing a voltage difference between the input voltage and the output voltage can be obtained.

At S200, the power switch can be controlled to be turned off for a predetermined time in each power frequency half-wave period to concentrate the input current on a time period during which a voltage difference between the two power terminals of the power switch is relatively small and the output current remains substantially constant. Further, the power switch may be controlled to be turned off for a first time duration when an input sampling signal or a difference sampling signal is increased to be greater than a compensation signal. The input sampling signal can characterize the input voltage, and the difference sampling signal can characterize the voltage difference between the input voltage and the output voltage. The compensation signal can characterize an error between a current flowing through the LED load and a desired current value. Further, the first time duration may be set such that an absolute value of an input alternating current voltage of the rectifier circuit connected to the power converter is less than the input voltage at the input terminal of the power converter when the power switch is turned on again.

In particular embodiments, the power switch may be controlled to be turned on for a second time duration when the input sampling signal is decreased to be below the compensation signal. The input sampling signal can characterize the input voltage, and the compensation signal can characterize the error between the current flowing through the LED load and the desired current value. Further, the power switch can be controlled to be turned on for a second time duration when the difference sampling signal is decreased to be below the compensation signal. The difference sampling signal can characterize the voltage difference between the input voltage and the output voltage, and the compensation signal can characterize the error between the current flowing through the LED load and the desired current value. Further, the second time duration may be determined such that the power switch can be turned on again in the falling phase of the input voltage at next power frequency half-wave period.

In particular embodiments, the power switch provided at a current path from the output terminal of the rectifier circuit to the capacitor and the LED load can be controlled to be turned off for a predetermined time in each power frequency half-wave period, such that the input current may be concentrated at the time period in which the voltage difference between the input voltage and output voltage is relatively small and the output current remain substantially constant. In this way, the voltage drop on the power switch during the on-time can be effectively reduced, which can reduce the associated loss, and accordingly improve the system efficiency.

The embodiments were chosen and described in order to best explain the principles of the invention and its practical applications, to thereby enable others skilled in the art to best utilize the invention and various embodiments with modifications as are suited to particular use(s) contemplated. It is intended that the scope of the invention be defined by the claims appended hereto and their equivalents.

What is claimed is:

1. A power converter for a light-emitting diode (LED) drive circuit, the power converter receiving an input voltage, and being configured to drive an LED load, the power converter comprising:

a) a capacitor and an LED load coupled in parallel to receive said input voltage;

b) a power switch coupled in series with said LED load, and being configured to control a current path from said input voltage to said LED load; and c) a control circuit configured to control an operation state of said power switch, such that an input current is generated during a first time period of a half power frequency period in a rising or a falling phase of said input voltage in which a voltage difference between two power terminals of said power switch is less than a predetermined value, in order to decrease power consumption of said power switch, wherein said control circuit is configured to control said power switch to cause a value of said input current during said first time period to be greater than a value of said input current during a second time period of said half power frequency period.

2. The power converter of claim 1, wherein:

a) said input current charges said capacitor and drives said LED load during a turn-on state of said power switch; and b) said current path is cut off and said capacitor discharges to supply a drive current for said LED load during a turn-off state of said power switch.

3. The power converter of claim 1, wherein:

a) said first time period is in a rising phase of said input voltage;

b) said second time period occurs after said first time period; and c) a voltage difference between two power terminals of said power switch during said first time period is less than said voltage difference between said two power terminals of said power switch during said second time period.

4. The power converter of claim 1, wherein:

a) said first time period is in a falling phase of said input voltage;

b) said second time period occurs after said first time period; and c) a voltage difference between two power terminals of said power switch during said first time period is less than said voltage difference between said two power terminals of said power switch during said second time period.

5. The power converter of claim 1, wherein said control circuit is configured to control said power switch to operate in a switching mode in accordance with a voltage difference between two power terminals of said power switch.

6. The power converter of claim 1, wherein said control circuit is configured to control said power switch to operate in a switching mode in accordance with a voltage difference between two power terminals of said power switch and a compensation signal representing an error between an output current flowing through said LED load and a desired current value.

7. The power converter of claim 1, wherein said second time period is determined such that an absolute value of an input alternating current voltage of a rectifier circuit coupled to said power converter is less than said input voltage of said power converter when said power switch is turned on again in next power frequency half-wave period.

8. The power converter of claim 1, wherein:

a) said control circuit is configured to control said power switch to turn off in accordance with a comparison between a difference sampling signal and a compensation signal;

b) said compensation signal characterizes an error between an output current flowing through said LED load and a desired current value; and c) said difference sampling signal characterizes a voltage difference between two power terminals of said power switch.

9. The power converter of claim 8, wherein said control circuit is configured to control said power switch to turn on in accordance with an input sampling representing said input voltage.

10. The power converter of claim 1, wherein said control circuit comprises:

a) a voltage sampling circuit configured to generate an input sampling signal or a difference sampling signal;

b) a compensation signal generating circuit configured to generate a compensation signal in accordance with a reference voltage and a current sampling signal, wherein said current sampling signal characterizes said input current or a load current flowing through said power switch; and c) said comparator being configured to receive said input sampling signal or a difference sampling signal at a first input terminal, and said compensation signal at a second input terminal, and to control said power switch by an output signal of said comparator.

11. The power converter of claim 10, wherein said control circuit further comprises a single triggered circuit coupled to said power switch, and being configured to generate a control signal in response to a transition of said output signal of said comparator.

12. The power converter of claim 1, further comprising a transistor coupled in series with said LED load, and being configured to control an output current flowing through said LED load, wherein said transistor is controlled by said control circuit.

13. The power converter of claim 12, wherein:

a) said transistor is controlled to operate in a linear region to adjust said output current; and b) a voltage difference between a control terminal and a power terminal of said transistor is controlled by an error between said output current and a desired current value.

14. The power converter of claim 1, wherein said input current is a single-pulse current during said first time period, and said input current drops to zero during said second time period.

* * * * *